US005234093A

United States Patent [19]

Abe et al.

[11] Patent Number: 5,234,093

[45] Date of Patent: Aug. 10, 1993

[54] VENDING MACHINE OF MANUALLY OPERATED LEVER TYPE

[75] Inventors: Hiroshi Abe; Takahito Yamamiya, both of Tokyo, Japan

[73] Assignee: Asahi Seiko Kabushiki Kaisha, Tokyo, Japan

[21] Appl. No.: 907,789

[22] Filed: Jul. 1, 1992

[30] Foreign Application Priority Data

Jul. 2, 1991 [JP] Japan ..... 3-256896
Oct. 14, 1991 [JP] Japan ..... 3-329400

[51] Int. Cl.[5] ..... G07F 5/02

[52] U.S. Cl. ..... 194/296; 221/26; 221/71; 221/72

[58] Field of Search ..... 194/296; 221/25, 26, 221/70, 71, 72

[56] References Cited

U.S. PATENT DOCUMENTS

| | | | |
|---|---|---|---|
| 661,130 | 11/1900 | Pape | 221/25 |
| 772,503 | 10/1904 | Dodson | 221/25 |
| 1,139,828 | 5/1915 | Wells et al. | 194/296 |
| 1,659,857 | 2/1928 | Coffman | 194/296 |
| 1,767,635 | 6/1930 | Weiss | 194/296 |
| 1,769,399 | 7/1930 | Swing | 194/296 |
| 1,813,934 | 7/1931 | Knee | 221/25 |
| 1,871,000 | 8/1932 | Klostermann | 194/296 |
| 1,901,529 | 3/1933 | Olsen | 194/296 |
| 2,365,165 | 12/1962 | Bauman et al. | 194/296 |
| 3,340,789 | 9/1967 | Simjian | 221/25 X |

FOREIGN PATENT DOCUMENTS 273559 6/1970 U.S.S.R. .

*Primary Examiner*—Robert P. Olszewski
*Assistant Examiner*—Dean A. Reichard
*Attorney, Agent, or Firm*—Hopgood, Calimafde, Kalil, Blaustein & Judlowe

[57] ABSTRACT

In a vending machine for discharging one of articles by manual operation of lever after depositing a coin, a rotary plate is rotated by the manual operation of the manual lever and a driven plate is rotated through the deposited coin which is received in a pocket formed by cooperation of the rotary plate and the driven plate. The driven plate drives an article discharging mechanism. An article discharging mechanism has a package separating mechanism for separating one package from a package belt having scored lines between adjacent packages to discharge it as the article. The package separating mechanism comprises a package guide roll for guiding one package thereon during rotation and elastic fingers rotating together with the package guide roll. The elastic fingers pinch the package onto the package guide roll with bending. The fingers rapidly return to the original shape from the bent shape by their elasticity to give a tension force to the package. The package is thereby separated from the package belt along the scored line.

10 Claims, 8 Drawing Sheets

VENDING MACHINE OF MANUALLY OPERATED LEVER TYPE

BACKGROUND OF THE INVENTION

The present invention relates to a vending machine and in particular, to a vending machine of a manually operated lever type.

In a known vending machine of such a type disclosed in Japanese Utility Model Publication 21332/67, a genuine coin selected by a coin selector is introduced to a gap between a lever referred to as a coin plate and a fixed plate referred to as a coin guide plate. The coin is engaged in the gap because the coin is larger than the gap. When a manually operated lever is pushed down, the coin is pressed into the gap an enlarges the gap to move the coin plate. The coin plate is turned on a supporting pivot and moves a link lever in a direction to move a ratchet. The movement of the ratchet moves a discharging plate by one pitch to discharge an article.

In the known vending machine, the discharging plate is driven by a small movement of the coin plate when the coin is pressed into the small gap between the coin plate and the coin guide plate, it is impossible to move the discharging plate over a long stroke or several pitches by manual operation of the lever. Accordingly, the known machine is possible to vend relatively small articles but is not suitable to vend relatively large articles.

Further, articles to be sold are often packages each of which contains goods packed by a wrap member. In some cases, the packages are prepared as connected each other to form a strip of continuous long package string or belt. When the articles are sold, each package must be separated from the package belt. In a vending machine handling such a package belt, any cutter is usually equipped for separating each package from the package belt. However, the cutter may injure operators who perform inspection and repair of the machine.

SUMMARY OF THE INVENTION

Therefore, it is an object of the present invention to provide a vending machine of a manually operated lever type which enables an article discharging mechanism to sufficiently move for discharging a large-scaled article by manual operation of the lever.

It is another object of the present invention to provide a vending machine handling a package belt which can separate each package from the package belt without use of any cutter such as a blade.

According to the present invention, a vending machine can be obtained which comprises: a machine housing having a coin depositing opening, a lever movement guide slit, and an article containing section: coin selecting means connected with the coin depositing opening for selecting a genuine coin deposited through the coin depositing opening to accept the genuine coin as an accepted coin: manual lever means having an end projecting outside the machine housing through the lever movement guide slit and being movable by manual operation of the projecting end along said lever movement guide slit; a rotary member rotatably supported on an axis and mechanically coupled with the lever means so that the rotary member rotates by movement of the lever means; a driven member having a rotary shaft rotatably supported on the axis, the driven member being adjacent the rotary member and cooperating with the rotary member to form a coin pocket for receiving the accepted coin as a received coin so that the driven member and the rotary member are mechanically coupled by the received coin and rotatable together to rotate the rotary shaft; and an article discharging mechanism coupled to the rotary shaft and responsive to rotation of the rotary shaft or discharging an article from the article containing section.

In the vending machine for handling as articles to be sold, packages continuously formed into a long package belt, each package containing predetermined quantity of goods, the package belt having scored lines at portions connecting adjacent packages, the article discharging mechanism comprises: package feeding rotor means coupled to and rotated by the rotary shaft for transferring the package belt to feed a first one of the packages into a package separating zone; and package separating means disposed in the package separating zone and coup and driven by the rotary shaft for receiving and separating the first package from the package belt, the package separating means comprises: package guide roll means rotated by the rotary shaft for receiving and transferring the first package thereon; and elastic finger means rotated by the rotary shaft for pinching the first package together with the package guide roll means and for applying tension force to the first package to separate the first package from the package belt along one of the scored lines.

DESCRIPTION OF THE PREFERRED EMBODIMENTS

Figure 1:
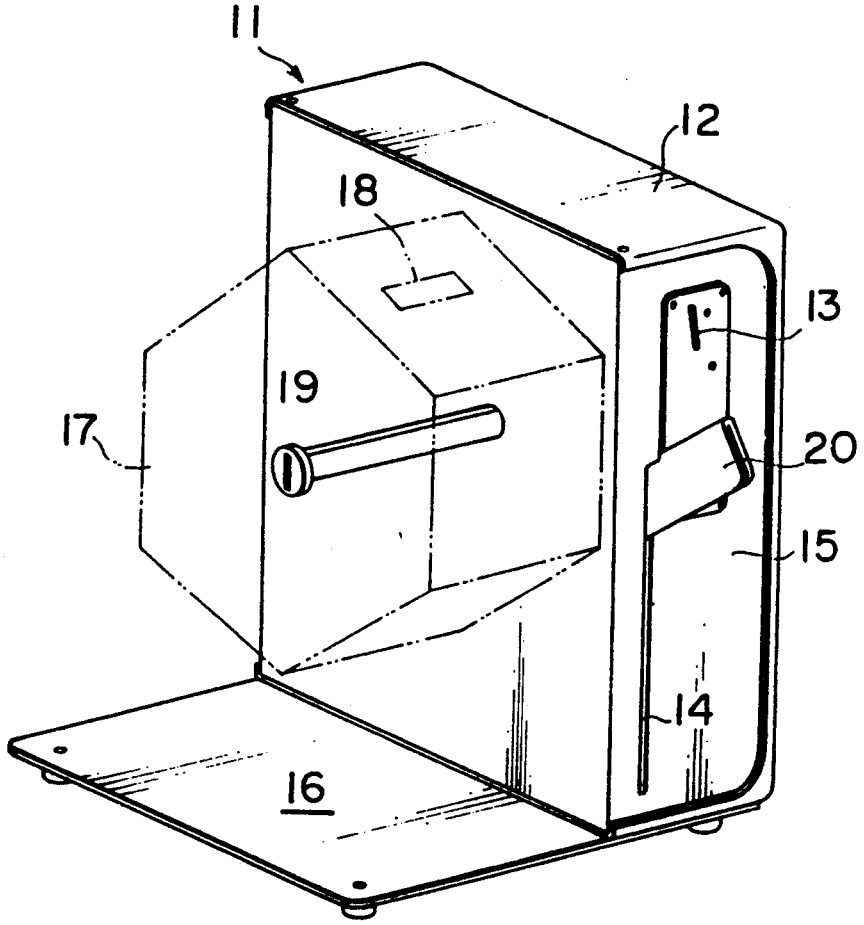
FIG. 1 is a schematic perspective view of a vending machine according to an embodiment of the present invention.

Referring to FIG. 1, a vending machine 11 according to an embodiment of the present invention comprises a machine housing 12. The machine housing 12 has a coin depositing opening 13 and a ever guide slit 14 in a front plate 15. The machine housing 12 further has an article containing section 16 in which articles to be dispensed are stored.

In the figure, a rotatable case 17 is mounted in the article containing section 16, the rotatable case 17 stores article and has a discharging port 18 in an outer surface thereof. The rotatable case 17 is mounted on a rotary shaft 19 and is rotatable together with the rotary shaft 19.

A lever 20 projects outside the machine housing 12 through the lever guide slit 14 and is selectively coupled to the rotary shaft 19, as described hereinafter.

When the lever 20 is moved along the lever guide slit 14 by manual operation after a coin is deposited through the coin depositing opening 13, the rotary shaft 19 is rotated together with the rotary case 17. Then, one of the articles is discharged through the discharging port 18.

Figure 2:
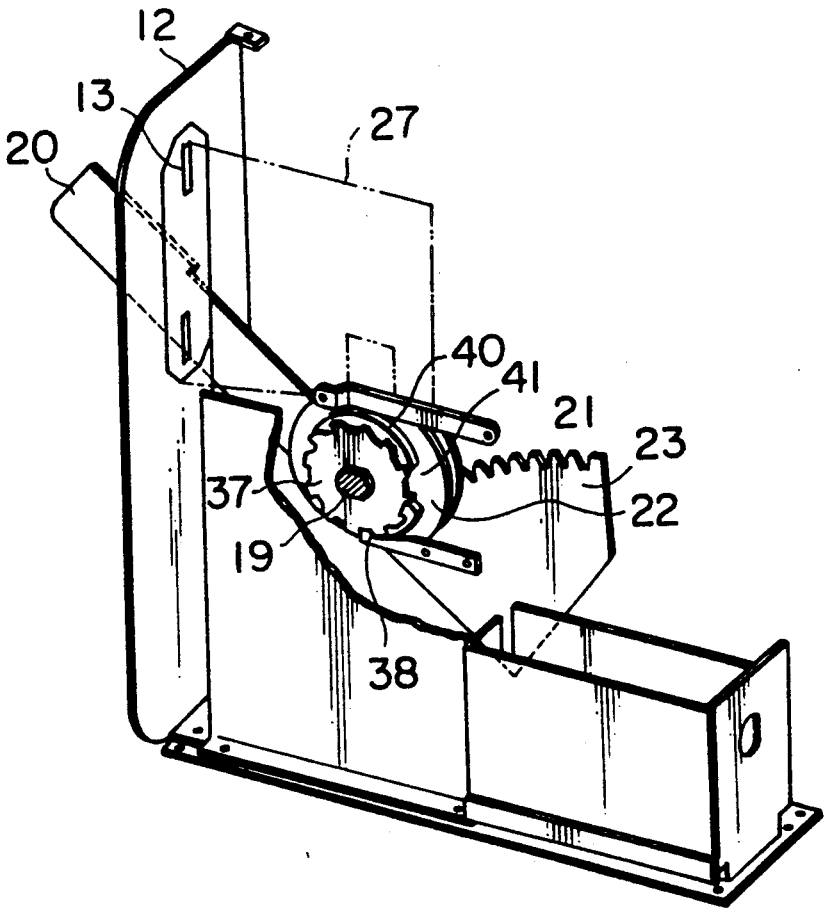
FIG. 2 is a perspective view of a coupling mechanism for coupling a lever with a rotary shaft in the vending machine of FIG. 1.

Referring to FIG. 2, a coupling mechanism for coupling the lever 20 and the rotatable shaft 19 comprises a rotary plate 21 rotatably mounted on an axis of the rotary shaft 19 and a driven plate 22 fixedly mounted on the rotary shaft 19. The rotary p a 21 is mechanically coupled with the lever 20 through a gear coupling including an arcuate gear 23.

Figure 3:
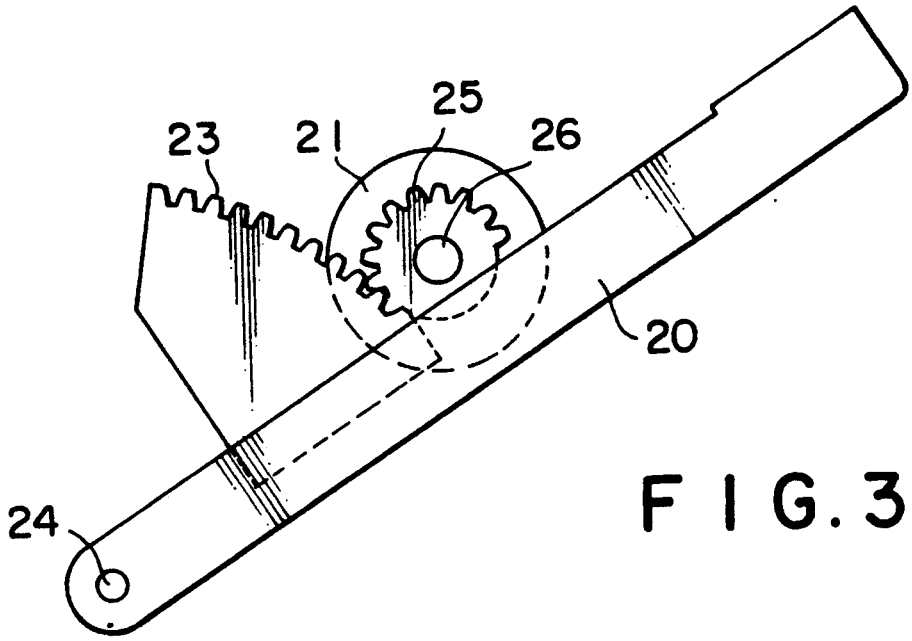
FIG. 3 is a side view illustrating a mechanism for coupling the lever and a rotary plate in FIG. 2.

Referring to FIG. 3, the lever 20 is pivotally mounted on a pivot pin 24 supported in the machine housing so that the lever 20 is turnable around the pivot pin 24 by manual operation of the lever 20 along the lever guide slit (14, FIG. 1). The lever 20 has the arcuate gear 23. The rotary plate 21 is associated with a gear 25 which is geared with the arcuate gear 23. Accordingly, when the lever 20 is manually turned around the pivot pin 24, the rotary plate 21 is rotated through coupling between the arcuate gear 23 and the gear 25. The gear 25 is formed on one side surface of the rotary plate 21 but can be fixedly mounted on a shaft 26 on which the rotary plate 21 is mounted.

The lever 20 is manually operated to move from an initial end to the opposite end of the lever guide slit 14. As a result, the rotary plate 22 is rotated by a predetermined angle. In the embodiment, the predetermined angle is selected 180°. Thereafter, the lever 20 should be returned to the initial end by manual operation or by any spring means.

Returning to FIG. 2, a coin selector 27 is mounted in the machine housing 12 and is connected to the coin depositing opening 13. The coin selector 27 is for selecting a genuine coin deposited through the coin depositing opening 13 and accepts the genuine coin as an accepted coin. The coin selector 27 rejects a false or imitative coin. The coin selector 27 is well known in the art. A known coin selector is used in the vending machine according to the present invention.

The rotary plate 21 and the driven plate 22 are selectively coupled by the accepted coin to rotate together with each other. That is, the rotary plate 21 and the driven plate 22 cooperate with each other to form a coin pocket for receiving the accepted coin. When the accepted coin is received as a received coin in the coin pocket, the rotary plate 21 and the driven plate 22 are mechanically connected with each other by the received coin. Accordingly, when the lever 20 is manually operated after a coin is accepted, the rotary plate 21 and the driven plate 22 are rotated together to rotate the rotary shaft 19. As a result, one of the articles is discharged through the discharging port (18, FIG. 1).

Figure 4:
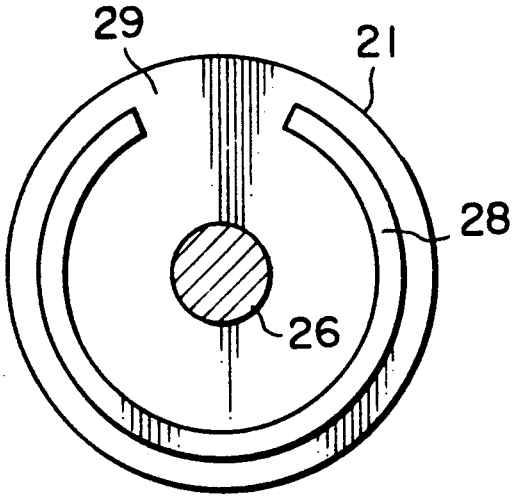
FIG. 4 is a side view of the rotary plate.

Referring to FIG. 4, the rotary plate 21 has a coaxial annular rim 28 fixedly mounted on a side surfaces opposite to the gear 25 (FIG. 3). The annular rim 28 has a thickness slightly larger than a thickness of the coin and is partially cut away to form a discontinuous portion 29 in the annular rim 28. A distance between opposite ends of the discontinuous portion 29 is determined slightly larger than a diameter of the coin.

Figure 5:
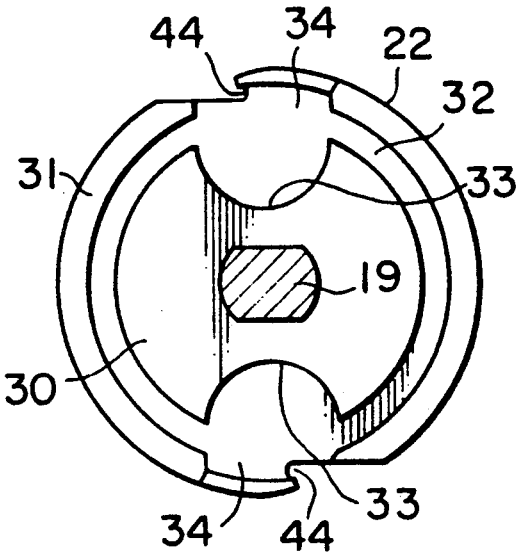
FIG. 5 is a side view of a driven plate shown in FIG. 2.

Referring to FIG. 5, the driven plate 22 is provided with a central circular land portion 30 and a coaxial outer annular rim 31 on a side surface facing rotary plate 21. The land portion 30 has an outer diameter slightly smaller than an inner diameter of the annular rim 28 (FIG. 4) of the rotary plate 21. The outer annular rim 31 has an inner diameter slightly larger than an outer diameter of the annular rim 28 of the rotary plate 21. The land portion 30 and the outer annular rim 31 determine an annular groove 32 therebetween. The annular groove 32 has a depth slightly larger than the thickness of the coin.

The land portion 30 is partially cut away at diametrically opposite positions to form semi-circular recesses 33. Each of the semi-circular recesses 33 has a radius slightly larger than a radius of the coin. The outer annular rim 31 is also partially cut away at the diametrically opposite positions similar to the recesses 33 and is thereby formed with two discontinuous portions as coin introducing ports 34. Those recesses 33 and coin introducing ports 34 are connected and continuous to the annular groove 32, and cooperate with the discontinuous portion 29 of the annular rim 28 of the rotary plate 21 to form a coin pocket for receiving the accepted coin.

Figure 6:
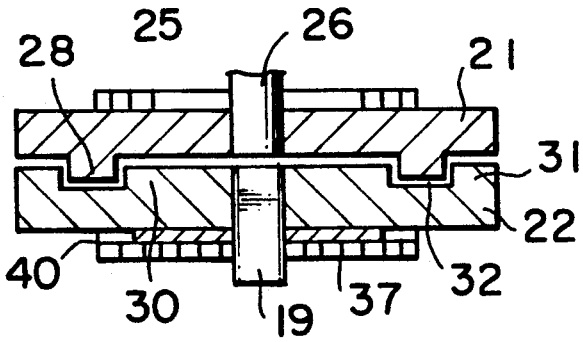
FIG. 6 is a lateral sectional view illustrating an assembled status of the rotary plate and the driven plate.
Figure 7:
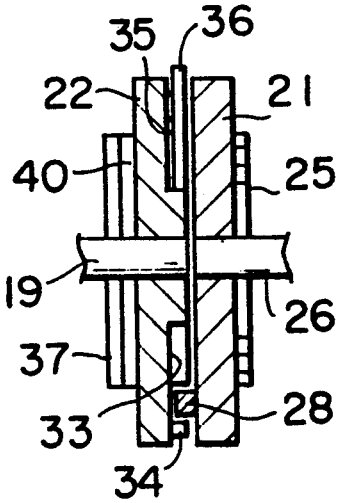
FIG. 7 is a vertical sectional view illustrating an assembled status of the rotary plate and the driven plate.

Referring to FIGS. 6 and 7, the rotary plate 21 and the driven plate 22 are disposed adjacent to each other so that the annular rim 28 of the rotary plate 21 is loosely fitted in the annular groove 32 of the driven plate 22. The discontinuous portion 29 of the rotary plate 21 is angularly positioned at one of the coin introducing ports 34 when the lever 20 is positioned at he initial end of the lever guide slit 14. Thus, the coin introducing port 34 and the corresponding recess 33 form a coin pocket 35 together with the discontinuous portion 29 of the annular rim 28. The accepted coin 36 is received in the coin pocket 35 as shown in FIG. 7.

When the accepted coin 36 is received in the coin pocket 35 as a received coin, the rotation of the rotary member 21 due to manual operation of the lever 20 is transferred to the driven plate 22 through the received coin 36. Thus, the driven plate 22 and the rotary shaft 19 are rotated together with the rotary plate 21.

When the lever 20 is moved to the opposite end of the lever guide slit 14, the rotary plate 21 and the driven plate 22 is rotated by an angle of 180°. Then the received coin 36 is discharged from the coin pocket 35. In detail, the coin pocket 35 is inverted and the received coin 36 therefore drops out of the coin pocket 35 into a coin box (not shown) disposed under the driven plate 22.

Accordingly, the coupling between the rotary plate 21 and the driven plate 22 is released and the rotary plate 21 is reversely rotated by returning operation of the lever 20 to the initial end of the lever guide slit 14. The driven plate 22 is maintained stationary. Thus, the discontinuous portion 29 of the annular rim 28 is positioned to the other recess 33 and coin introducing port 34 to form a fresh coin pocket for receiving a next accepted coin.

Figure 8:
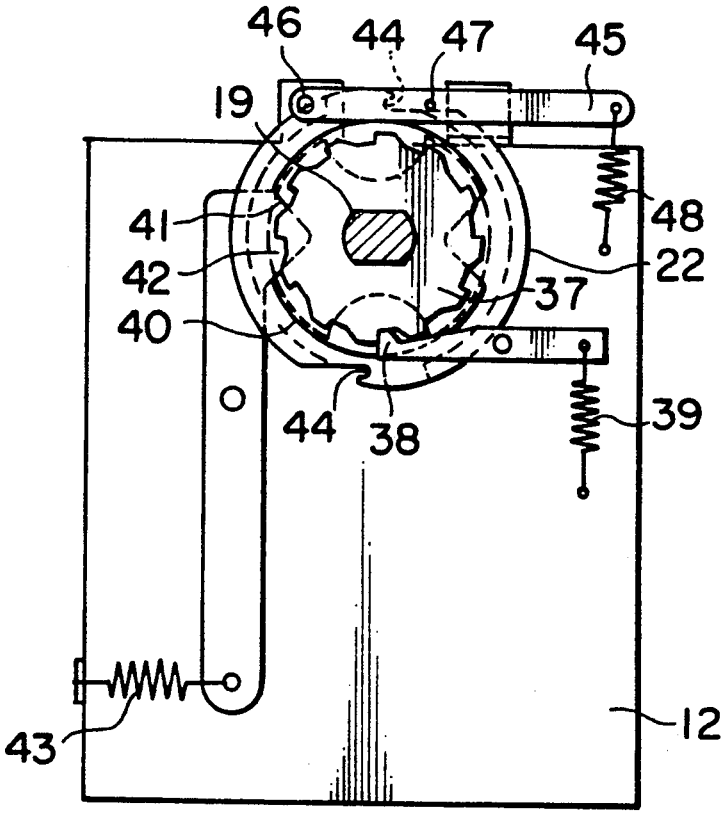
FIG. 8 is a side view of the coupling mechanism of FIG. 2.

Referring to FIG. 8 together with FIGS. 2, 6 and 7, the driven plate 22 is associated with a ratchet wheel 37 which is engaged with a ratchet 38 urged by means of a spring 39 so that the ratchet 38 engages with the ratchet wheel 37. Accordingly, the ratchet wheel 37 and the driven plate are prevented from reversely rotating.

The driven plate 22 is also associated with a positioning plate 40 which is fixedly mounted on the rotary shaft 19 or formed integral with the driven plate 22. The positioning plate 40 is provided with two cut-away portions 41 at diametrically opposite positions. An engagement member 42 is urged onto the outer surface of the positioning plate 40 by means of a spring 43. The engagement member 42 is disposed to engage with one of the cut-away portions 41 when the driven plate 22 is located at an angular position where one of the coin introducing ports 34 is located under the coin selector 27. Thus, the driven plate 22 is stationarily maintained at the angular position so that the accepted coin is reliably introduced into the coin pocket 35 through the coin introducing port 34.

Referring to FIGS. 2, 5 and 8, the vending machine further comprises a stopper mechanism for preventing the rotary shaft 19 from forwardly rotating when no coin is received in the coin pocket 36. The driven plate 22 is provided with two grooves 44 in the outer surface thereof adjacent the coin introducing ports 34. A stopper lever 45 is pivoted at 46 in the machine housing 12 and has a stopper pin 47. The stopper lever 45 is urged by means of a spring 48 so that the stopper pin 47 engages with one of the grooves which is positioned under the coin selector 27. Therefore, the driven plate 22 and the rotary shaft 19 are prevented from rotation by engagement of the groove 44 with the stopper pin 47. When the accepted coin is received in the coin pocket 35, the received coin pushes the stopper pin 47 against the spring 48 at a start of rotation of the rotary plate 21 and the driven plate 22 and disengages the stopper pin 47 from the groove 44.

The provision of the stopper mechanism prevents any erroneous article vending due to incorrect rotation of the article case 17 when no coin is received in the coin pocket.

Now, description will be made as to an embodiment of the article containing section including an article discharging mechanism driven by the rotation of the rotary shaft 19 of the vending machine in FIGS. 1–8.

Figure 9:
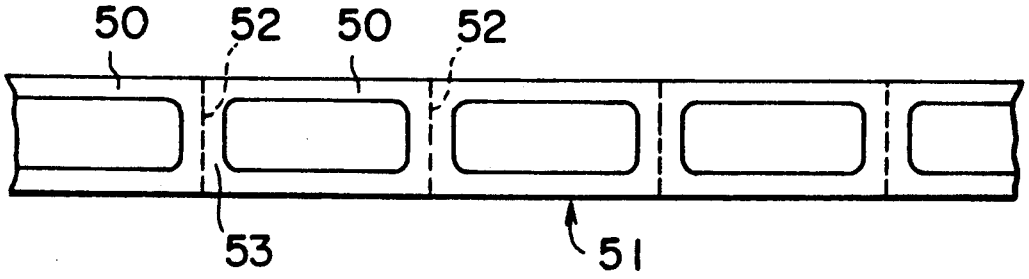
FIG. 9 is a plan view of a package belt.

Referring to FIG. 9, the articles are packages 50 each containing goods packed by a wrap member. A series of packages 50 are connected to each other to form a strip of continuous a long package string or belt 51. The package belt 51 is scored or perforated along lines to form scored lines 52 at connecting portions 53 between adjacent packages 50 so that the package belt 51 is readily folded and separated into each package by application of tensile force.

Figure 10:
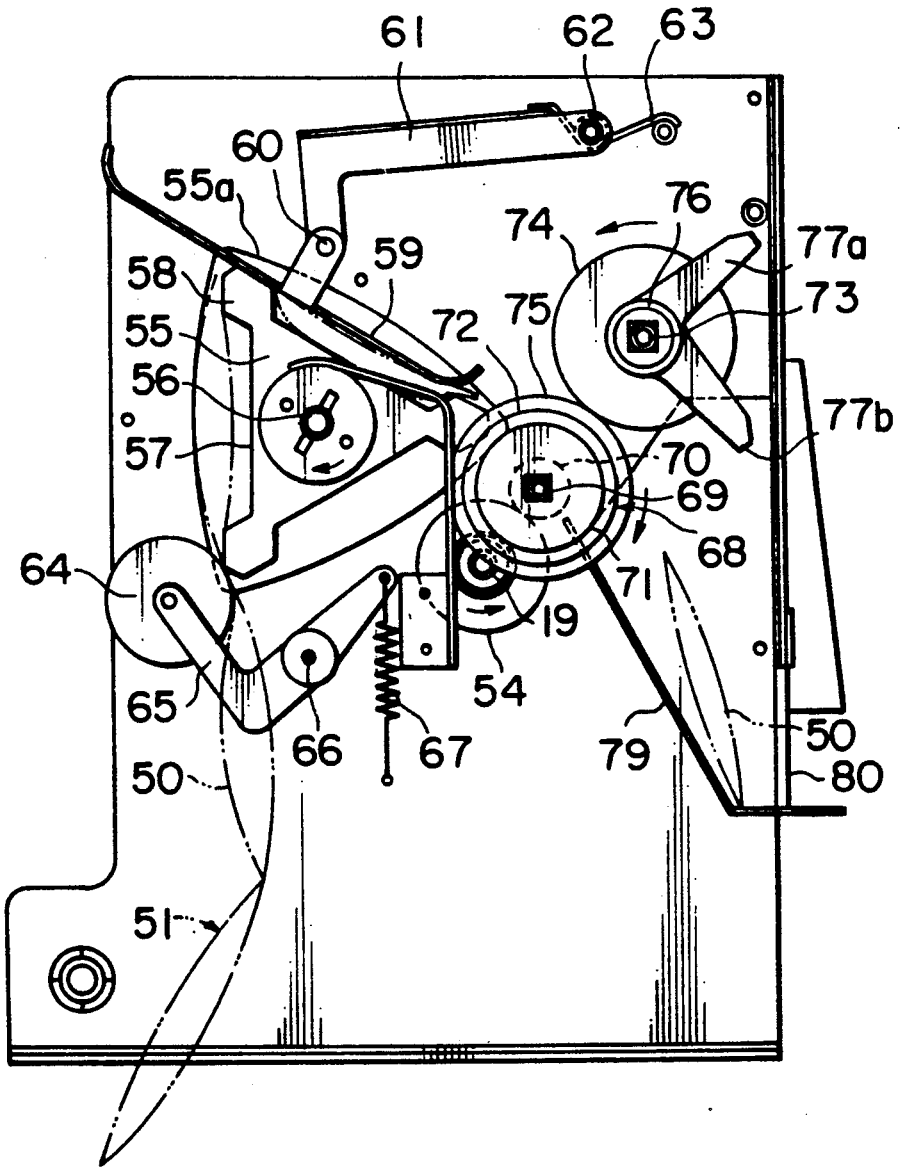
FIG. 10 is a side view of an article discharging mechanism according to another embodiment.
Figure 11:
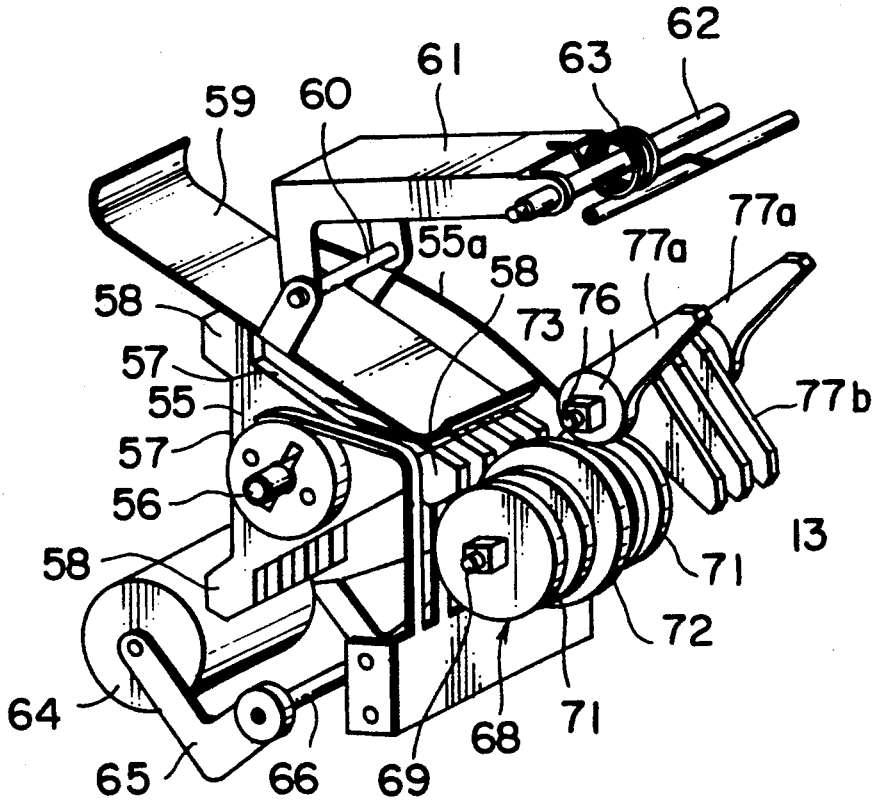
FIG. 11 is a perspective view of the article discharging mechanism.

Referring to FIGS. 10 and 11, the rotary shaft 19 extends into the article containing section and is provided with a gear 54 fixed thereon.

A package feeding rotor 55 is fixedly mounted on a rotor shaft 56 which is in parallel with and is driven by the rotary shaft 19 through any transmission mechanism such as a gear (not shown) engaging with the gear 54. The package feeding rotor 55 is generally a regular polygon member having an axial length generally equal to a width of the package belt 51. In the shown embodiment, the package feeding rotor 55 is a regular triangle member and is provided with recesses 57 in three sides for receiving packages 50 of the package belt 51. The package feeding rotor 55 is usually positioned so that three recesses 57 are located at three different angular positions, that is, a package introducing position, a package feeding position and a vacant position. The package feeding rotor 55 rotates in the direction so that each of recesses 57 shifts from the package introducing position to the vacant position through the package feeding position.

From a pile of folded package belt 51, a leading edge of the package belt is led onto the package feeding rotor 55 and two packages at the leading edge, that is, a leading package and a next package, are received in the recesses 57 located at the package feeding position and the package introducing position. In response to rotation of the rotary shaft 19 over half a complete revolution, the package feeding rotor 55 rotates over one third ($\frac{1}{3}$) of a complete revolution, so that the recess receiving the leading package shifts from the package feeding position to the vacant position, the leading packages being fed to a separating zone. Another recess 57 located at the package introducing position shifts to the package feeding position, and the other recess 57 located at the vacant position shifts to the package introducing position with the next package 50 being received therein.

The package feeding rotor 55 may be formed so that each of apexes 58 of the triangle member is axially divided into a comb teeth as shown in FIG. 11. Alternatively, the package feeding rotor 55 may be formed with a plurality of regular triangle plates fixed together with gaps therebetween.

The package feeding rotor 55 is provided with side plates 55*a* at opposite ends of the regular triangle member for preventing packages from moving out of the recesses 57. In FIG. 11, one of the side plates 55*a* is shown and the other is omitted for illustrating the structure of the package feeding rotor 55.

In order to guide and depress the package into the recess 57 at the package feeding position, a guide plate 59 is disposed opposite the recess at the package feeding position. The guide plate 59 is rotatably supported on a pivot pin 60 in parallel with the rotor shaft 56 which is supported at an end of a lever 61. The lever 61 is rotatably supported at the opposite end on a fixed shaft 62 which is supported in parallel with the rotor shaft 56 by the machine housing. A spring 63 is provided to urge the lever 61 so as to depress the guide plate 59 onto the recess 57 at the package feeding position. When the package feeding rotor 55 rotates, the apex 58 pushes up the guide plate 59 against the spring 63.

In order to guide one package 50 into one recess 57 shifted from the vacant position to the package introducing position and to prevent the package from floating from the recess, a pinch roller 64 is provided to be pressed onto the apex 58 between recesses 57 located at the package introducing position and the vacant position. The pinch roller 64 is rotatably supported on a pair of tension levers 65 which are biassed by a spring 67 so that the pinch roller 64 is pressed onto the apex 58.

In the separating zone, a package guide roll 68 is provided to receive and transfer the package 50 fed from the package feeding rotor 55. The package guide roll 68 is mounted on a roll shaft 69 which is parallel with the rotary shaft 19. The roll shaft 69 is provided with a gear 70 engages with the gear 54 of the rotary shaft 19 and thereby rotates one revolution by rotation of the rotary shaft 19 over half of a complete revolution.

The package guide roll 68 may be a single roll body but may be a plurality of disks 71 assembled with gaps therebetween shown in FIG. 11. The package guide roll 68 is disposed so that the gaps receive the comb teeth of each apex of the package feeding rotor 55. The package is reliably transferred from the recess 57 at the package feeding position to the package guide roll 68.

A central one 72 of the plurality of disks may have a radius larger than that of the other ones. Thus, the package is reliably guided without deflection sideward.

In parallel with the roll shaft 69, another shaft 73 is supported on the machine housing 12. The shaft 73 has a gear 74 engaging with a gear 75 on the roll shaft 69 and rotates one revolution by rotation of roll shaft 69 over one revolution.

The shaft 73 is provided with a hub 76 which is provided with a plurality of fingers 77 radially extending therefrom. Two fingers *77a* at opposite ends are angularly spaced by an angle of 90° from the other fingers *77b*. All of the fingers 77 have a radial length larger than a distance from the outer surface of the hub 76 to the outer surface of the guide roll 68 or the smaller disks 71 so that the ends of the fingers 77 are interfered with the outer surface of the guide roll 68, when the fingers 77 are rotated together with the shaft 73.

The fingers 77 are made of elastic material having a hardness of 45 degrees by JIS. such as chloroprene rubber, ethylene plopylene rubber or the like.

The guide roll 68 may also be made of the similar elastic material.

Accordingly, after the fingers 77 come into contact with the outer surface of the guide roll 68, the fingers 77 are gradually bent with rotation of the roll 68 and fingers 77 and eventually disengaged from the guide roll 68. Then, the fingers 77 rapidly return to the original shape from the bent shape by the elasticity.

Figure 12:
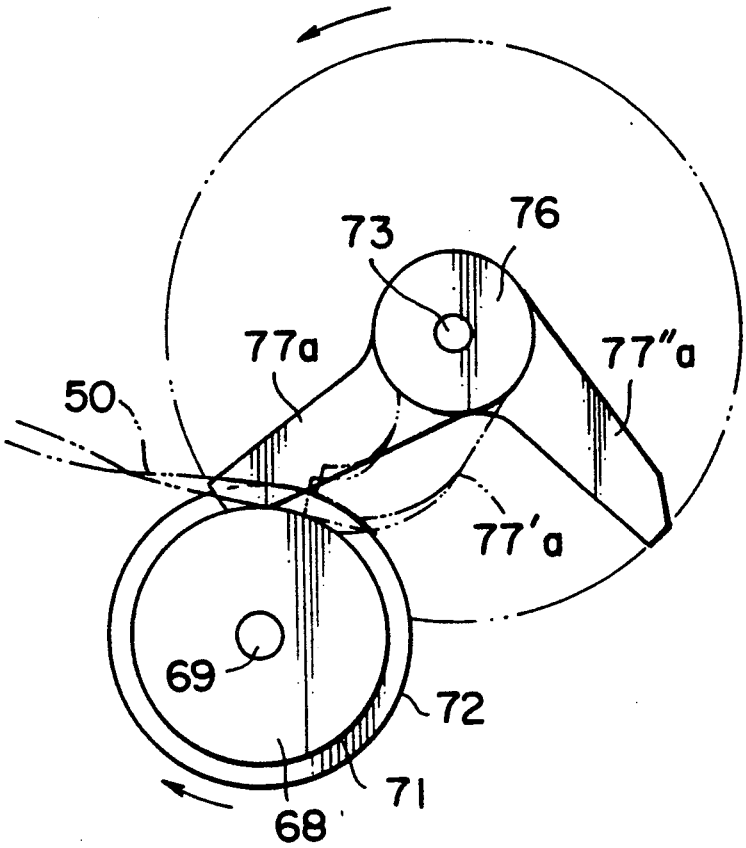
FIGS. 12–15 are schematic views illustrating separation of one package from the package belt by combination of a package guide roll and fingers.
Figure 13:
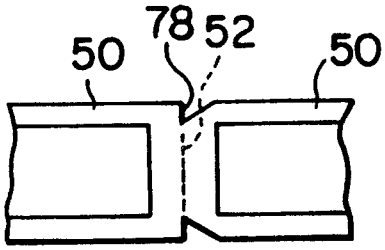

Referring to FIG. 12, when the package feeding rotor 55 and the package guide roll 68 rotate in the direction and when the fingers 77 rotates in the opposite direction, the opposite end fingers *77a* firstly come into contact with the outer surface of the package guide roll 68 through side peripheries of the package fed from the package feeding roller 55 to the package guide roll 68. Thereafter, the side fingers *77a* are gradually bent as shown by *77'a* by rotation of the package guide roll 68 and fingers *77a*. Eventually, the side fingers *77a* rapidly depart the package guide roll 68 and are returned to their original forms as shown at *77''a* by their elasticity. At the time, the side fingers *77a* momentarily give tension force to the side peripheries of the package 50, so that the package 50 is partially separated from the adjacent or the next following packages at the both side peripheries along the scored line 52, as shown at 78 in FIG. 13.

Figure 14:
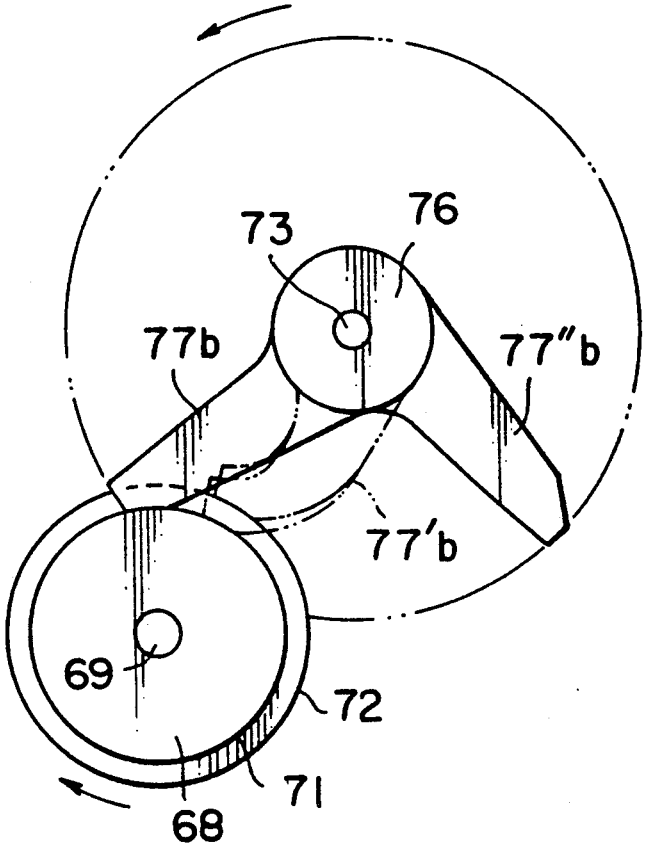
Figure 15:
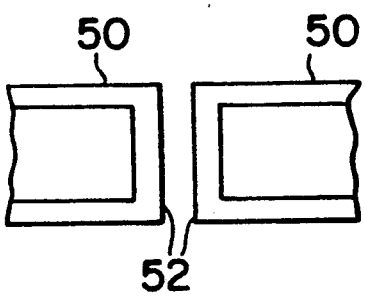

Thereafter, the other fingers *77b* come into contact with the package 50 on the package guide roll 68 and are then bent depressing it onto the package guide roll 68, as shown at *77'b*, in FIG. 14. Eventually, the fingers *77b* rapidly depart from the outer surface of the package guide roll 68 and return to their original form is shown at *77''b* FIG. 14. At the same time, the fingers *77b* momentarily give tension force to the package 50 and separate the package 50 from the next package at the scored line 52 as shown in FIG. 15. The separated package 50 is then flipped by the fingers *77b* and drops on a chute 79 towards an article accessing opening 80.

Thus, the discharging operation of the discharging mechanism is completed for one article vending.

What is claimed is:

1. A vending machine for discharging articles therefrom which comprises:

a rotary member rotatably supported on an axis and having a rotary side surface, said rotary member having an inner annular rim fixedly disposed on said rotary side surface, said inner annular rim having inner and outer diameters and a thickness comparatively larger than an accepted coin of specified thickness and diameter, said inner annular rim having a discontinuous portion or opening of size comparatively larger than the diameter of said coin, a driven member having a rotary shaft coaxially disposed on said axis and having a driven side surface facing and in cooperative association with said rotary member, said driven member being provided with a central circular land portion and with an outer annular rim on said driven side surface, said land portion having an outer diameter comparatively smaller than the inner diameter of the annular rim of said rotary member.

the inner diameter of said outer annular rim of said driven member being comparatively larger than the outer diameter of said inner annular rim of said rotary member, said land portion and said outer annular rim thereof defining an annular groove therebetween of depth comparatively larger than the thickness of said coin, said land portion having a semi-circular recess at its outer periphery of a diameter comparatively larger than the diameter of said coin, said outer annular rim of said driven member having a coin-introducing port cooperatively associated with said semi-circular recess, said inner annular rim of said rotary member being rotatably fitted in said annular groove with said discontinuous portion or opening operatively associated with said coin-introducing port, such that said coin-introducing port and said semi-circular recess form a coin pocket together with said discontinuous portion or opening for receiving said coin so that said coin with received mechanically couples said driven member and said rotary member and cause them to rotate together about said rotary shaft; and an article discharging mechanism coupled to said rotary shaft and responsive to the rotation of said rotary shaft for discharging an article from said vending machine.

2. A vending machine as claimed in claim 1 wherein said land portion is provided with two semicircular recesses at diametrically opposite positions, wherein said outer annular rim is also provided with two coin introducing ports at diametrically opposite positions, and wherein said discontinuous portion or opening of said inner annular rim of said rotary member is alternatingly and angularly positioned at one of said coin introducing ports to form said coin pocket.

3. A vending machine as claimed in claim 1, comprising a housing and which further includes a stopper mechanism in which:

said driven member is provided with a groove in the outer surface thereof adjacent said coin introducing port;

a stopper pin;

a stopper lever means supporting said stopper pin and pivotally connected to said machine housing; and spring means urging said stopper lever means so that said stopper pin engages with said groove, said stopper mechanism preventing said rotary shaft from forwardly rotating when no coin is received in said coin pocket.

4. A vending machine as claimed in claim 1, wherein said articles are packages continuously formed into a long package belt, each package containing a predetermined quantity of goods, said package belt having a scored lines at portions connecting adjacent packages, wherein said article discharging mechanism comprises:

package feeding rotor means coupled to and rotated by said rotary shaft for transferring said package belt to feed a first one of said packages into a package separating zone;

package separating means disposed in said package separating zone and coupled to and driven by said rotary shaft for receiving and separating said first package from said package belt, said package separating means comprising:

package guide roll means rotated by said rotary shaft for receiving and transferring said first package thereon; and elastic finger means rotated by said rotary shaft for pinching said first package together with said package guide roll means and for applying tension force to said first package to separate said first package from said package belt along one of said scored lines.

5. A vending machine as claimed in claim 4, wherein said package feeding rotor means is a regular polygon member having an axial length generally equal to a width of said package belt, said polygon member having package receiving recesses in side surfaces thereof.

6. A vending machine as claimed in claim 5, wherein one of said recesses is positioned as a package feeding recess at a package feeding position when rotation of said rotary shaft due to said manual operation of said manual lever means is completed, one package received in said package feeding recess being fed as said first package by next operation of said manual lever means.

7. A vending machine as claimed in claim 6, which further comprises:

guide plate means for guiding and depressing said one package into said package feeding recess; and means supported on said machine housing for urging said guide plate means to depress said one package.

8. A vending machine as claimed in claim 6, wherein another one of said recesses is positioned as a package introducing recess at a package introducing position, and which further comprises:

pinch roller means cooperating with said package feeding rotor means for guiding said package belt to introduce as an introduced package a package of said package belt thereinto and for preventing said introduced package from floating from said package introducing recess.

9. A vending machine as claimed in claim 4, wherein said elastic finger means comprises opposite end fingers and fingers disposed between said opposite end fingers in said axial direction, said opposite end fingers being angularly spaced from said other fingers, said opposite end fingers, upon rotating, firstly coming into contact with said package guide roll means and gradually bent to pinch both side edges of said first package with said package guide roll means, then said opposite end fingers rapidly and momentarily departing from said package guide roll means to give tension force to said first package to thereby partially separate said first package from said package belt along one of said scored lines.

10. A vending machine as claimed in claim 9, wherein said other fingers come into contact with said package guide roll means after said opposite end fingers, said other fingers are also gradually bent to pinch said first package with said package guide roll means, then said other fingers rapidly and momentarily departing said package guide roll means to give tension force to said first package to thereby completely separate said first package from said package belt along said one of said scored lines.

* * * * *

UNITED STATES PATENT AND TRADEMARK OFFICE

CERTIFICATE OF CORRECTION

PATENT NO. : 5,234,093

DATED : August 10, 1993

INVENTOR(S) : Hiroshi Abe et al.

It is certified that error appears in the above-identified patent and that said Letters Patent is hereby corrected as shown below:

Column 10, claim 9, line 19, insert --other-- before "fingers" (first occurrence).

Signed and Sealed this

Twelfth Day of April, 1994

*Attest:*

Bruce Lehman

BRUCE LEHMAN

*Attesting Officer*

*Commissioner of Patents and Trademarks*